US008959813B2

(12) United States Patent
Denby et al.

(10) Patent No.: US 8,959,813 B2
(45) Date of Patent: Feb. 24, 2015

(54) DISPLAY SYSTEM INCLUDING CONVERTIBLE FIXTURE

(71) Applicant: Target Brands, Inc., Minneapolis, MN (US)

(72) Inventors: Scott Denby, Minneapolis, MN (US); Joseph R. Stukenberg, St. Louis Park, MN (US); Timothy James Martell, Brooklyn Park, MN (US); Daniel Joseph Noll, Madison, WI (US)

(73) Assignee: Target Brands, Inc., Minneapolis, MN (US)

( * ) Notice: Subject to any disclaimer, the term of this patent is extended or adjusted under 35 U.S.C. 154(b) by 112 days.

(21) Appl. No.: 13/826,475

(22) Filed: Mar. 14, 2013

(65) Prior Publication Data

US 2014/0259831 A1 Sep. 18, 2014

(51) Int. Cl.

| | |
|---|---|
| ***A47F 5/00*** | (2006.01) |
| ***A47F 5/10*** | (2006.01) |
| ***G09F 15/00*** | (2006.01) |

(52) U.S. Cl.

CPC ..... *A47F 5/10* (2013.01); *G09F 15/0056* (2013.01); *G09F 15/0068* (2013.01); *A47F 5/103* (2013.01)

USPC ..... 40/606.03; 40/606.01; 211/175; 211/204

(58) Field of Classification Search

CPC ..... G09F 23/00; G09F 7/02; G09F 7/18; G09F 7/20; G09F 15/0006

USPC ..... 40/610, 611.05, 611.06, 607.04, 40/607.09, 606.19; 248/157, 188, 188.8; 211/204, 206–208, 175

See application file for complete search history.

(56) References Cited

U.S. PATENT DOCUMENTS

| | | | | |
|---|---|---|---|---|
| 1,258,941 | A | | 3/1918 | Pease |
| 1,862,776 | A | * | 6/1932 | Timberlake ..... 40/606.19 |
| 2,710,241 | A | | 6/1955 | Lieberman |
| 2,798,618 | A | | 7/1957 | Singer |
| 2,893,568 | A | | 7/1959 | Scholz |
| 3,142,124 | A | | 7/1964 | Ownbey |
| 3,297,374 | A | | 1/1967 | Radek |
| 3,411,634 | A | | 11/1968 | Pesce |
| 3,601,256 | A | | 8/1971 | Bowers, Jr. et al. |
| 3,737,048 | A | | 6/1973 | Giroux |
| 3,830,374 | A | | 8/1974 | Kassimir |
| 3,856,320 | A | | 12/1974 | Blanchard |

(Continued)

OTHER PUBLICATIONS

Photographs of a Merchandise Display Fixture used in Target stores publicly used as early as 2009 (4 pages).

*Primary Examiner* — Casandra Davis

(74) *Attorney, Agent, or Firm* — JoAnn M. Seaton; Griffiths & Seatons PLLC

(57) ABSTRACT

A convertible fixture includes a support structure and a vertical extender. The support structure includes a pair of vertical supports, each defining an open top end. The vertical extender is adjustably coupled with the support structure and includes side arms and a middle bar. The side arms extend substantially parallel to each other and each defines a top end. Each side arm is formed with a single closed shape cross section and is slidably received within a different vertical support of the pair of vertical supports. The middle bar extends between the side arms and includes two substantially parallel rails defining an elongated slot between the substantially parallel rails. The elongated slot extends along a majority of a length of the middle bar. The side arms and the middle bar are formed as a single, unitary component.

21 Claims, 15 Drawing Sheets

(56) References Cited

U.S. PATENT DOCUMENTS

| | | | | | |
|---|---|---|---|---|---|
| 3,865,250 | A | | 2/1975 | Jay | |
| 4,046,083 | A | | 9/1977 | Murdoch et al. | |
| 4,127,196 | A | | 11/1978 | Boucher | |
| 4,191,298 | A | | 3/1980 | Broudy | |
| 4,312,452 | A | * | 1/1982 | Waier | 211/23 |
| 4,325,197 | A | * | 4/1982 | Achten et al. | 40/610 |
| 4,327,514 | A | | 5/1982 | Bourque | |
| 4,331,245 | A | | 5/1982 | Schell | |
| 4,380,298 | A | | 4/1983 | Harig | |
| 4,444,322 | A | | 4/1984 | Lee | |
| 4,460,097 | A | | 7/1984 | Darnell, II et al. | |
| 4,516,620 | A | * | 5/1985 | Mulhern | 160/351 |
| 4,716,841 | A | | 1/1988 | Suttles | |
| 4,790,092 | A | | 12/1988 | Farmer | |
| 4,798,013 | A | | 1/1989 | Sainato | |
| 4,916,840 | A | * | 4/1990 | Getz | 40/605 |
| 4,925,038 | A | | 5/1990 | Gajewski | |
| D318,194 | S | | 7/1991 | Terrell et al. | |
| D319,934 | S | | 9/1991 | Terrell et al. | |
| 5,272,991 | A | | 12/1993 | Carrigan, Jr. | |
| 5,433,046 | A | | 7/1995 | MacQuarrie et al. | |
| D371,026 | S | | 6/1996 | Hendler et al. | |
| 5,535,898 | A | | 7/1996 | Burgess, Sr. et al. | |
| 5,607,070 | A | | 3/1997 | Hellyer | |
| 5,611,442 | A | | 3/1997 | Howard | |
| 5,615,636 | A | * | 4/1997 | Gustafson | 116/223 |
| 5,653,349 | A | | 8/1997 | Dana et al. | |
| 5,660,637 | A | | 8/1997 | Dodge | |
| D394,360 | S | | 5/1998 | Geier et al. | |
| 5,799,428 | A | | 9/1998 | Poindexter | |
| 5,881,892 | A | | 3/1999 | Loo | |
| D409,858 | S | | 5/1999 | Reed | |
| 5,918,750 | A | | 7/1999 | Jackson | |
| 5,921,190 | A | | 7/1999 | Wood | |
| 5,944,203 | A | | 8/1999 | Vlah et al. | |
| D417,978 | S | | 12/1999 | Reed | |
| 6,009,651 | A | | 1/2000 | Current | |
| 6,029,833 | A | | 2/2000 | Yeh | |
| 6,053,115 | A | | 4/2000 | Felton | |
| D427,457 | S | | 7/2000 | Heiny et al. | |
| D427,814 | S | | 7/2000 | Black | |
| 6,105,292 | A | | 8/2000 | Current | |
| D435,743 | S | | 1/2001 | Glauth et al. | |
| D450,948 | S | | 11/2001 | Stafford et al. | |
| D451,300 | S | | 12/2001 | Stafford et al. | |
| 6,364,137 | B1 | | 4/2002 | Glauth et al. | |
| 6,427,855 | B2 | | 8/2002 | LaBruna, Jr. et al. | |
| D466,331 | S | | 12/2002 | Chang | |
| 6,488,160 | B2 | | 12/2002 | Wang | |
| 6,493,974 | B2 | | 12/2002 | Tramont | |
| D470,685 | S | | 2/2003 | Chang | |
| D474,350 | S | | 5/2003 | Sardis | |
| 6,561,365 | B2 | | 5/2003 | Bustos | |
| 6,561,366 | B2 | | 5/2003 | Kim-So | |
| 6,644,484 | B1 | | 11/2003 | Sardis | |
| 6,669,037 | B1 | | 12/2003 | Ahn | |
| D495,523 | S | | 9/2004 | Harwanko | |
| 6,935,062 | B2 | | 8/2005 | Lowry et al. | |
| 6,935,523 | B2 | | 8/2005 | Ahn | |
| 6,959,824 | B1 | | 11/2005 | Alperson | |
| D533,738 | S | | 12/2006 | Berg et al. | |
| D544,730 | S | | 6/2007 | Stukenberg | |
| D554,919 | S | | 11/2007 | Clark et al. | |
| D571,130 | S | | 6/2008 | Clark et al. | |
| D571,131 | S | | 6/2008 | Clark et al. | |
| 7,500,574 | B1 | | 3/2009 | Miller, III et al. | |
| D601,833 | S | | 10/2009 | Stukenberg | |
| D602,713 | S | | 10/2009 | Stukenberg | |
| D603,627 | S | | 11/2009 | Wen | |
| 7,644,527 | B2 | | 1/2010 | Clark et al. | |
| D622,084 | S | * | 8/2010 | Stukenberg et al. | D6/467 |
| 7,810,658 | B2 | | 10/2010 | Clark et al. | |
| 7,946,435 | B2 | | 5/2011 | Clark et al. | |
| 7,988,000 | B2 | | 8/2011 | Clark et al. | |
| D667,904 | S | * | 9/2012 | DeFrancisci | D21/691 |
| 2007/0170139 | A1 | * | 7/2007 | Clark et al. | 211/189 |
| 2009/0013572 | A1 | | 1/2009 | Clark et al. | |
| 2009/0250422 | A1 | | 10/2009 | Clark et al. | |
| 2011/0209329 | A1 | | 9/2011 | Clark et al. | |

* cited by examiner

DISPLAY SYSTEM INCLUDING CONVERTIBLE FIXTURE

BACKGROUND OF THE INVENTION

Display structures are useful for increasing retail traffic toward a particular grouping of merchandise. Because space is often limited in retail stores, display space is at a premium. Hence, in tight spaces display structures are particularly useful for supporting merchandise and additionally displaying signage or other conspicuous indicia to attract customer attention to the merchandise. For example, the signage may extend upright from a side portion of a vertical display structure for visibility to customers walking by. In other cases, display structures include low tech interactive components, such as rotating panels or racks, or high tech components, such as interactive displays for inclusion of signage or indicia. Signage can be attached to a display structure for directing a customer to a designated location in a retail store and/or used to alert the customer of a sale or discount event in progress. In any case, a variety of differently configured display structures are used to promote customer interest.

SUMMARY OF THE INVENTION

One aspect of the present invention relates to a convertible fixture including a support structure and a vertical extender. The support structure includes a pair of vertical supports. Each vertical support of the pair of vertical supports is substantially hollow and defines an open top end. The vertical extender is adjustably coupled with the support structure and includes a pair of side arms and a middle bar. The pair of side arms extends substantially parallel to each other and each defines a top end. Each side arm of the pair of side arms is formed with a single closed shape cross section and is slidably received within a different vertical support of the pair of vertical supports through the corresponding open top end of the different vertical support. The middle bar extends between the top ends of the pair of side arms and includes two substantially parallel rails defining an elongated slot between the two substantially parallel rails. The elongated slot extends along a majority of a length of the middle bar. The pair of side arms and the middle bar are formed as a single, unitary component. Other fixtures, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Embodiments of the present invention are configured to provide convertible fixtures that increase display area on a display structure in an aesthetically pleasing manner. The convertible fixtures include adjustable vertical extenders that are used to attach signage to front and/or rear portions of the display structures. Additionally, the convertible fixtures can be employed to not only display signage, but to also display merchandise.

According to one embodiment, the adjustable vertical extender includes a top, dual rail bar extending between two side bars configured to be inserted into top openings of corresponding vertically-extending supports of a display structure. Each side bar has one or more interior-facing slots formed along its length that are configured to align with interior-facing apertures in the corresponding vertically-extending supports and to receive a fastener for maintaining vertical position of the fixture relative to the display structure.

In one embodiment, the convertible fixture is used with a sign attachment mechanism to couple a sign to one rail of the top, dual rail bar. In particular, the sign attachment mechanism is configured to include a connector to attach to and at least partially wrap around one of the rails of the top bar and to receive a sign. For example, the sign attachment mechanism is coupled to the front rail or the rear rail of the top dual rail bar. A second sign attachment mechanism can be coupled to the other of the front and rear rails so that two signs each facing opposite directions are simultaneously coupled to the display structure. As another alternative, the sign attachment mechanism is configured to sit on top of the top dual rail bar so that a sign extends vertically above the top bar.

Figure 1:
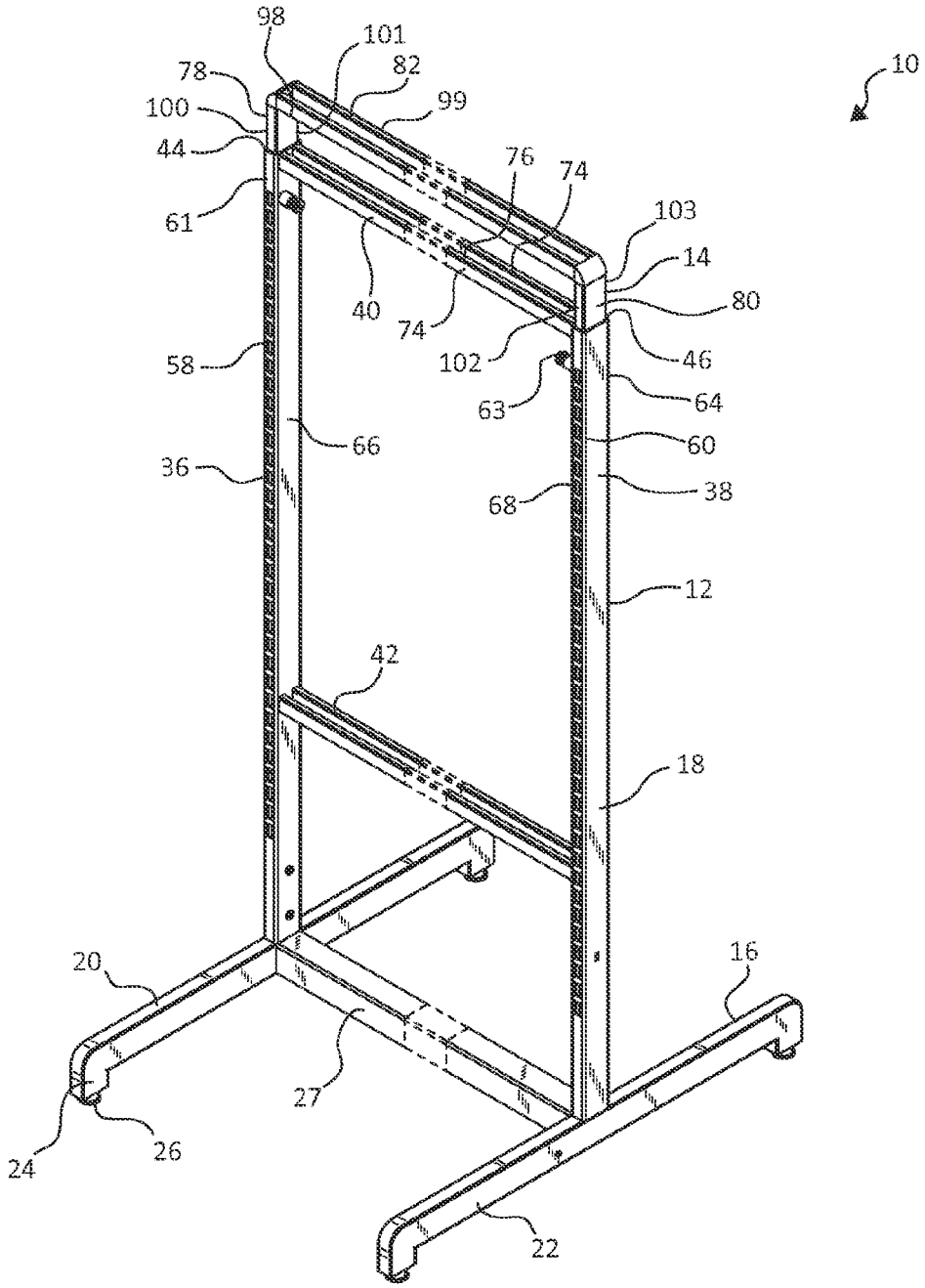
FIG. 1 is a front, perspective view illustration of a display structure, according to one embodiment of the present invention.
Figure 2:
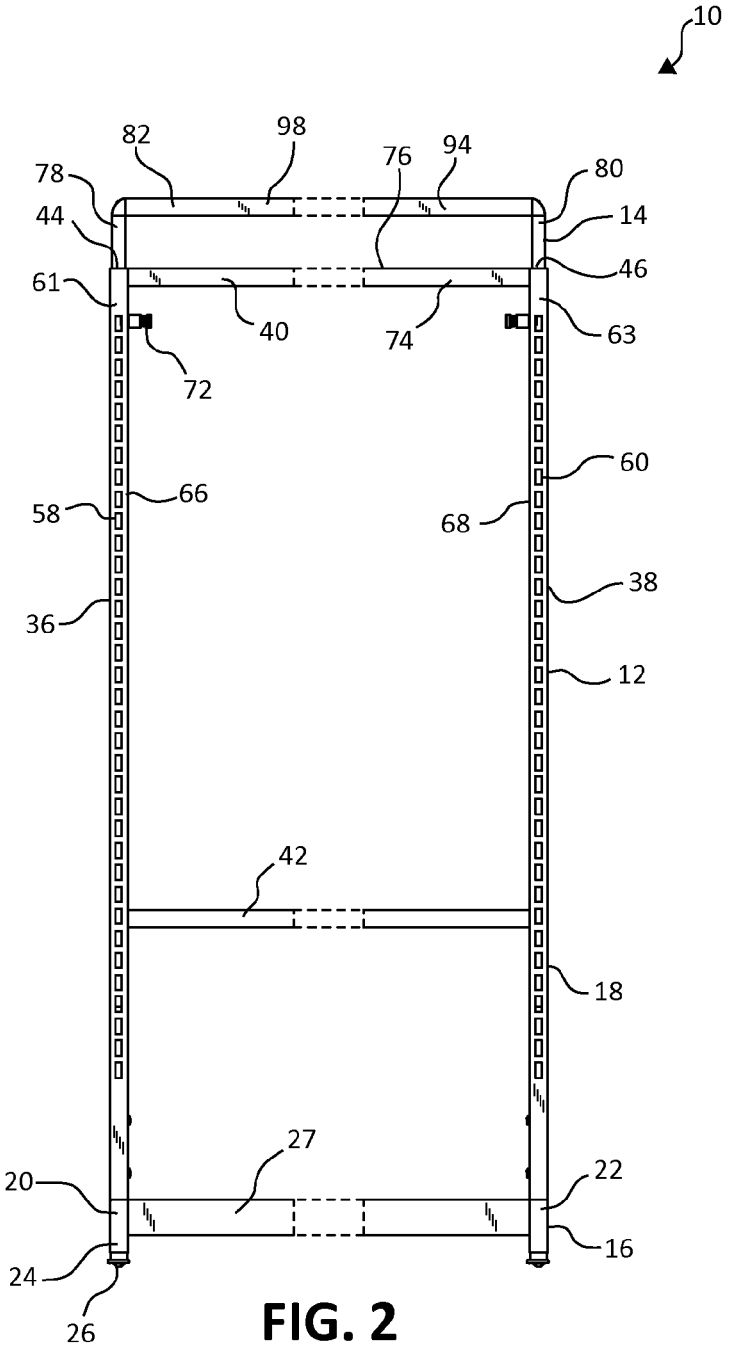
FIG. 2 is a front view illustration of the display structure of FIG. 1, the rear view being identical to the front view, according to one embodiment of the present invention.
Figure 3:
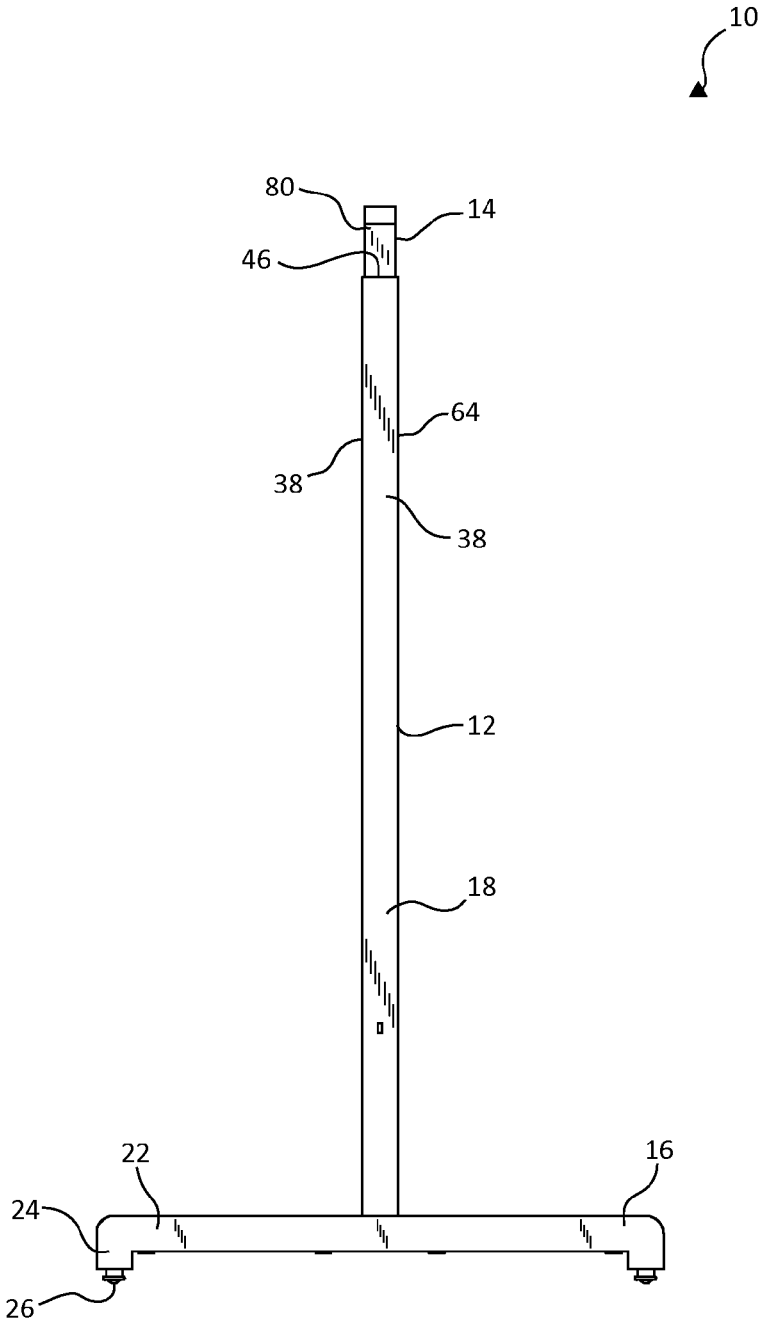
FIG. 3 is a right side view illustration of the display structure of FIG. 1, the left side view being identical to the right side view, according to one embodiment of the present invention.
Figure 4:
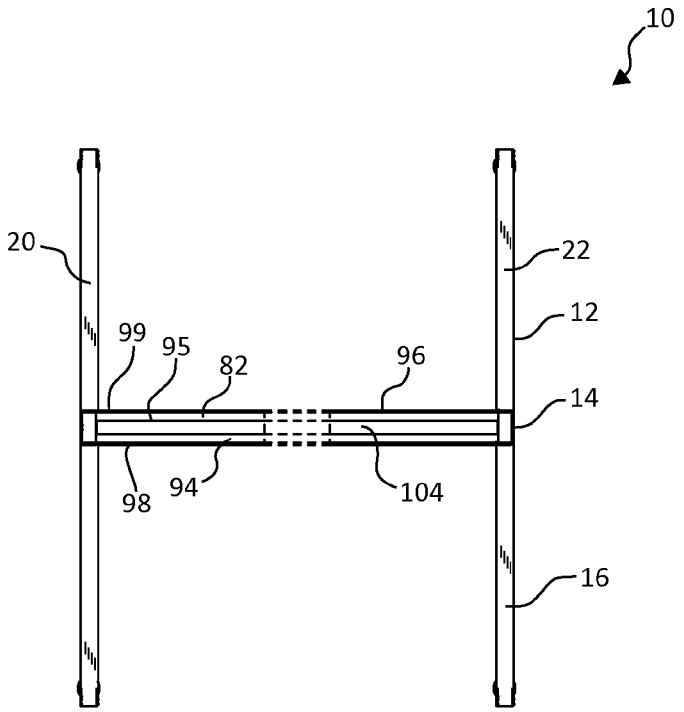
FIG. 4 is a top view illustration of the display structure of FIG. 1, according to one embodiment of the present invention.
Figure 5:
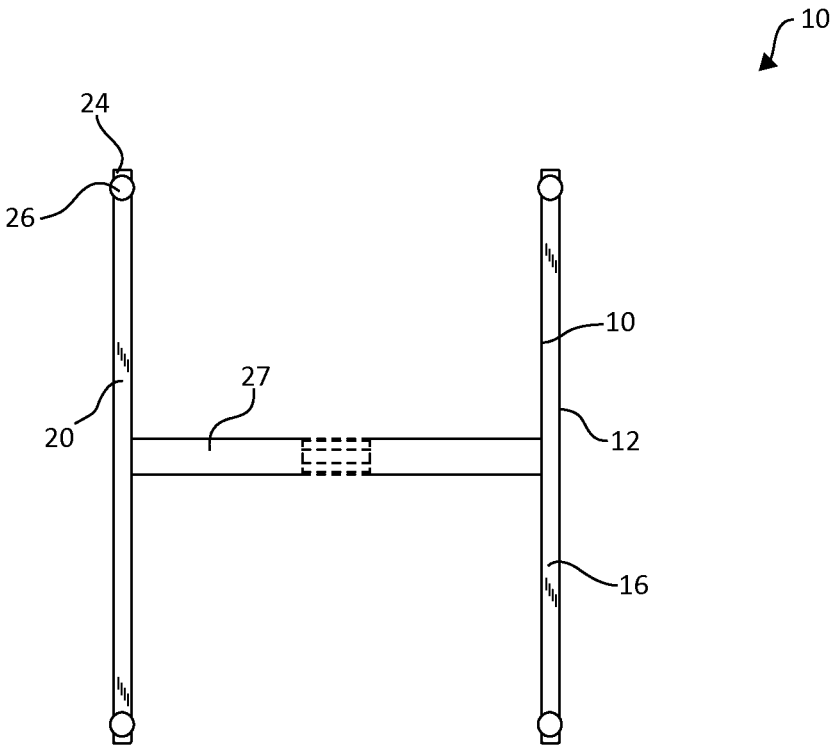
FIG. 5 is a bottom view illustration of the display structure of FIG. 1, according to one embodiment of the present invention.
Figure 6:
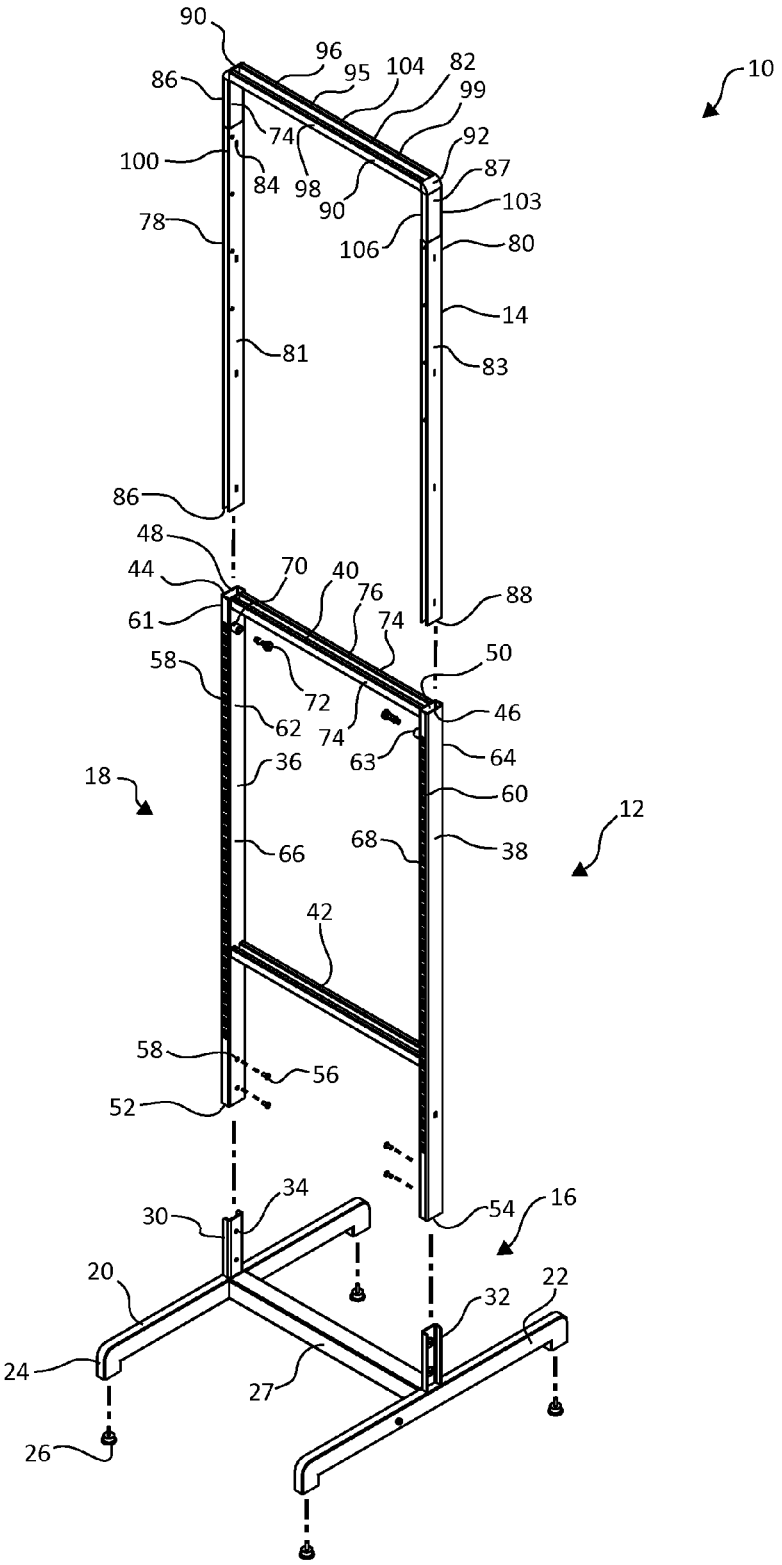
FIG. 6 is an exploded, perspective view illustration of the display structure of FIG. 1, according to one embodiment of the present invention.

Referring now to FIGS. 1-6, a convertible fixture 10 is illustrated. Convertible fixture 10 includes a support structure 12 and an adjustable vertical extender 14 slidably coupled with support structure 12. Support structure 12 provides a base 16 and a frame 18 to support vertical extender 14. For example, base 16 includes two horizontally extending legs or support legs 20 and 22 that extend substantially parallel to each other. Each of the ends of legs 20 and 22 has vertically extending feet 24 to elevate legs 20 and 22 a distance above a support surface (not shown). Ball casters or pins 26 are inserted at the bottom of each foot 24 to maintain legs 20 substantially even with each other when base 16 is placed on the support surface. In one embodiment, pins 26 are removed and replaced with casters (not shown) as will be apparent to those of skill in the art upon reading this application. A connector leg 27 extends between legs 20 and 22 spaces the two legs 20 and 22 a desired distance apart from each other. Referring to FIG. 6, connector post 30 extends substantially orthogonally with respect to connector leg 27 and horizontal leg 20 from an intersection thereof, and connector post 32 extends substantially orthogonally with respect to connector leg 27 and horizontal leg 22 from an intersection thereof. Each of connector posts 30 and 32 are configured to couple base 16 to frame 18 and include fastener openings 34 for aligning with corresponding openings on frame 18.

Base 16 is formed as a unitary component or, alternatively, each component is separately formed and subsequently welded or otherwise suitably coupled to one another. In one embodiment, base 16 is formed of metal, such as steel plated with titanium, or another sturdy material.

Frame 18 includes vertical or upright supports or segments 36 and 38 and horizontal supports or segments 40 and 42 extending therebetween. Vertical supports 36 and 38 have top ends 44 and 46 each including top openings 48 and 50 formed therein for receiving corresponding portions of vertical extender 14. Bottom ends 52 and 54 include openings (not shown) that are configured to receive connector posts 30 and 32, respectively. In one example, to secure vertical supports 36 and 38 to connector posts 30 and 32, interior-facing openings 58 formed on vertical supports 36 and 38 correspond with fastener openings 34 of connector posts 30 and 32 and fasteners 56 are inserted therethrough. Arrays of slots 58 and 60 are formed on forward and rear surfaces 61 and 62 of vertical support 36 and on forward and rear surfaces 63 and 64 of vertical support 38 to receive hooks or other coupling mechanism for hanging shelving or other display areas on support structure 12. Interior surfaces 66 and 68 of vertical support 36 and 38, respectively, include apertures 70 for receiving pins 72 to secure vertical extender 14 at a particular position, as will be described in further detail below.

Horizontal support 40 extends between top ends 44 and 46 of vertical supports 36 and 38 and has a double rail configuration including rails 74. Each rail 74 has a square or otherwise suitably shaped cross section and is selected to have longitudinal surfaces that are about one-third of a width of interior surfaces 66 and 68. In an embodiment, top surface 76 of each rail 74 extends in the same plane as a topmost edge of top ends 44 and 46, and side surfaces of each rail 74 are located just inside of forward and rear surfaces 61, 62, 63, and 64 of vertical supports 36 and 38, respectively. In another embodiment, the top surface 76 of each rail 74 is located just below the topmost edge of top ends 44 and 46. In on embodiment, rails 74 are substantially parallel to each other and spaced a distance apart to allow coupling mechanisms to fit therebetween. In another embodiment, rails 74 have a circular or other suitably shaped cross section.

Horizontal support 42 is configured substantially similarly to horizontal support 40 and extends between vertical support 36 and 38 at a location below that of horizontal support 40. For example, horizontal support 42 is located at a position about two-thirds of the length of vertical supports 36 and 38 below horizontal support 40. In another example, horizontal support 42 is disposed at another position.

Figure 8:
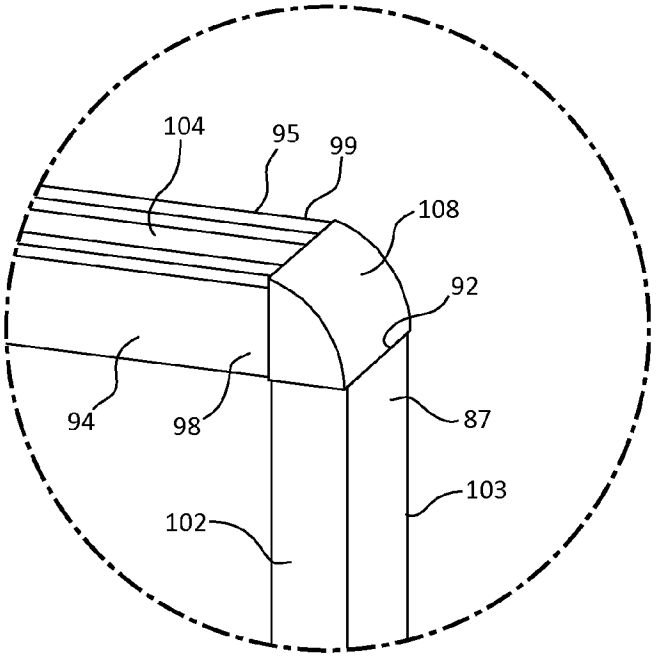
FIG. 8 is close-up view illustration of a portion of the extended component of FIG. 7 bounded by dotted line 8, according to one embodiment of the present invention.
Figure 7:
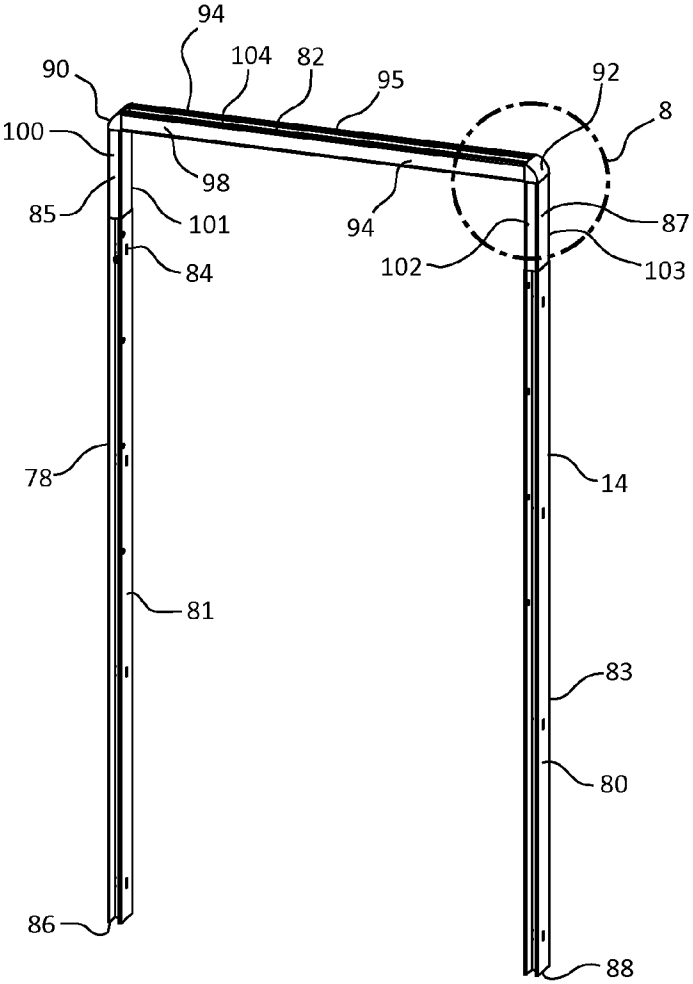
FIG. 7 is a front, perspective view illustration of a extender component of the display structure of FIG. 6, according to one embodiment of the present invention.
Figure 9:
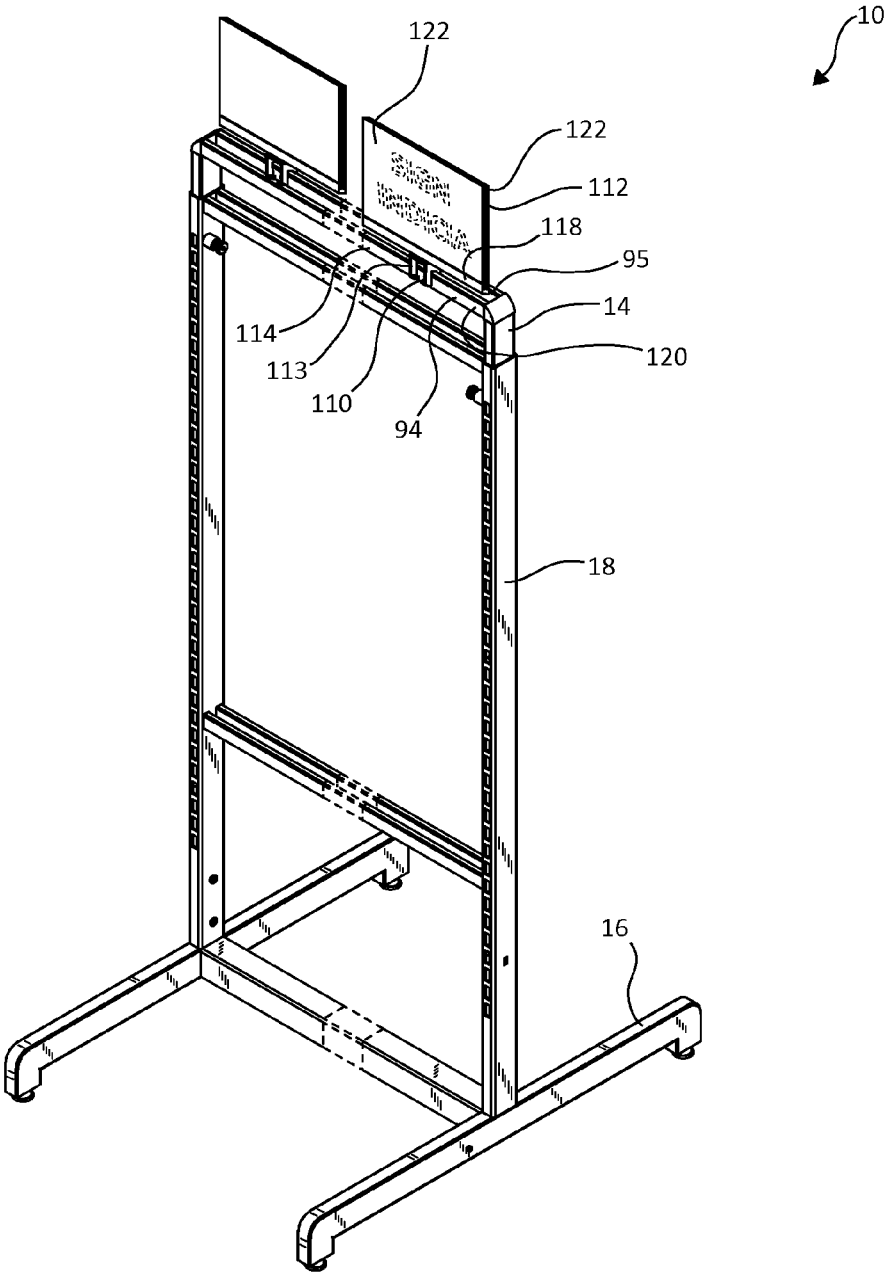
FIG. 9 is a front, perspective view illustration of a display structure including signage, according to one embodiment of the present invention.
Figure 10:
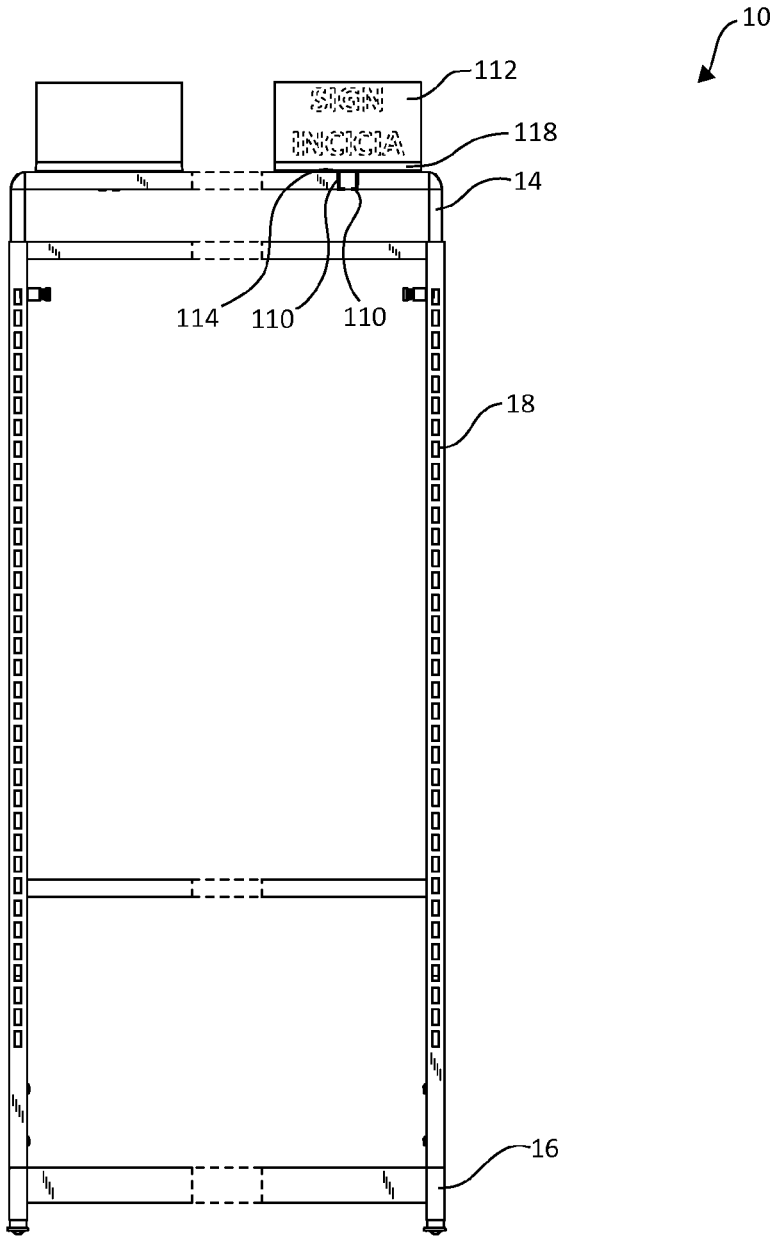
FIG. 10 is a front view illustration of the display structure of FIG. 9, according to one embodiment of the present invention.
Figure 11:
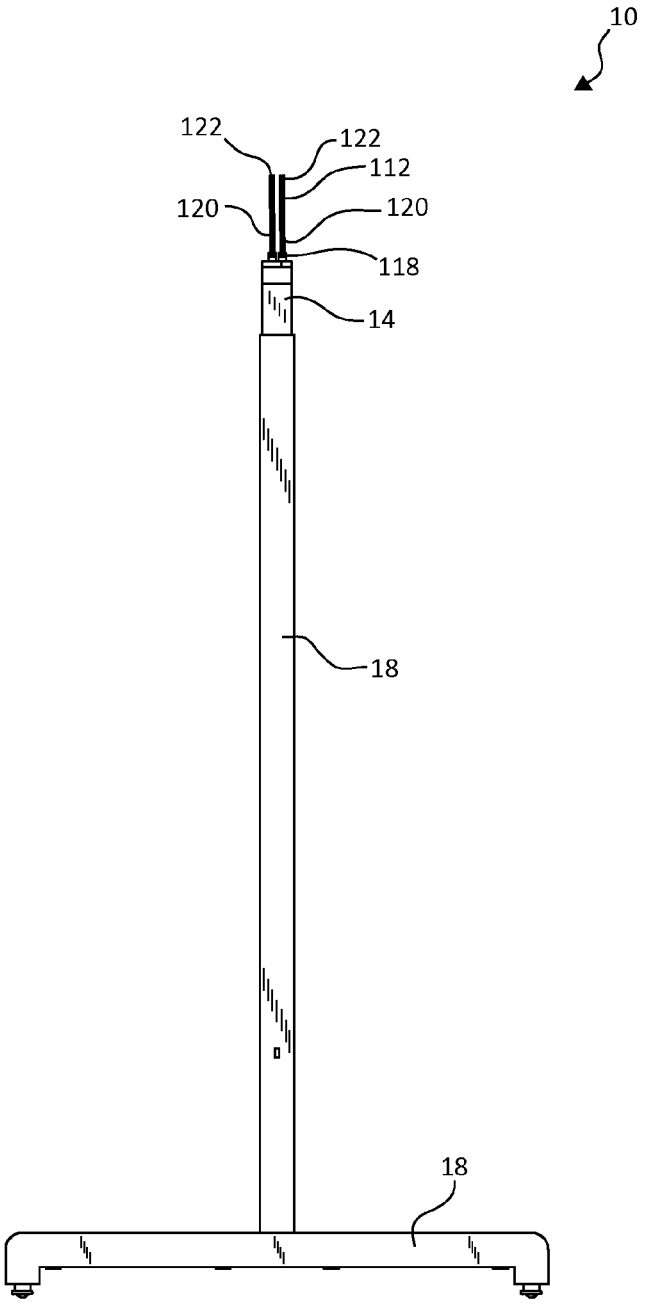
FIG. 11 is a side view illustration of the display structure of FIG. 9, according to one embodiment of the present invention.
Figure 12:
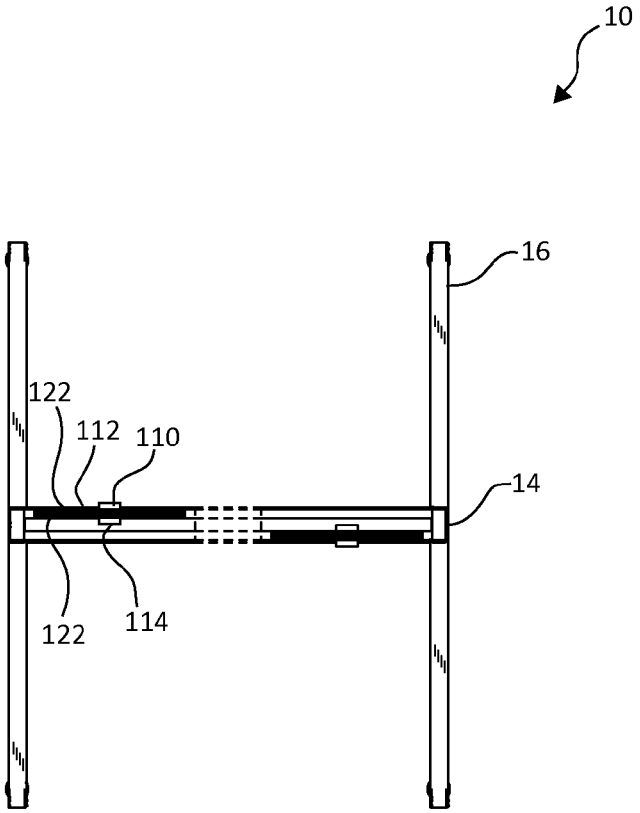
FIG. 12 is a top view illustration of the display structure of FIG. 9, according to one embodiment of the present invention.
Figure 13:
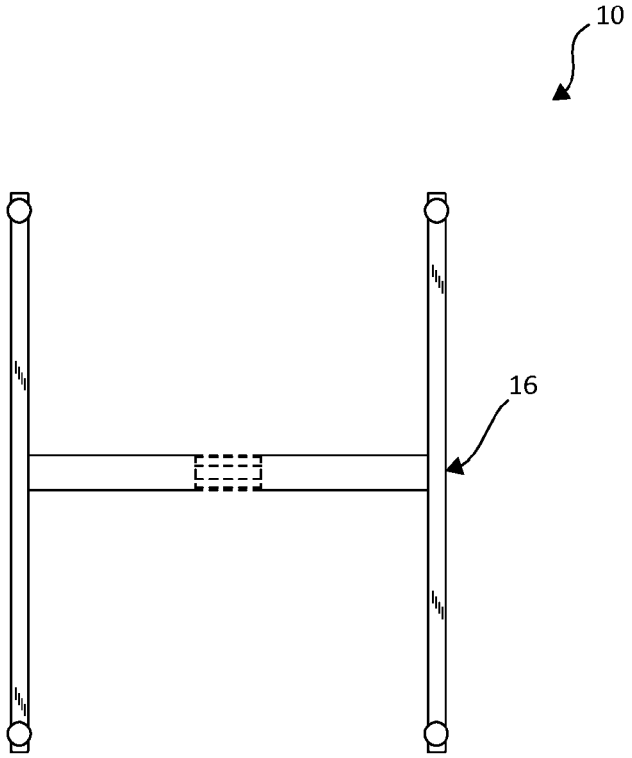
FIG. 13 is bottom view illustration of the display structure of FIG. 9, according to one embodiment of the present invention.

With additional reference to FIGS. 6-8, vertical extender 14 is a single, unitary U-shaped component configured to provide additional display area to display structure 12. In particular, when vertical extender 14 is slidably coupled to frame 18, vertical extender 14 selectively adjusts an overall height of display structure 12.

In one embodiment, vertical extender 14 includes two arms 78 and 80 opposite one another and a middle bar 82 extending therebetween. Arms 78 and 80 are substantially parallel to each other and disposed a distance apart that corresponds to the distance between vertical supports 36 and 38. In one example, each arm 78 and 80 is configured to be substantially equal in length to vertical supports 36 and 38. Alternatively, arms 78 and 80 are longer or shorter than supports 36 and 38. Although arms 78 and 80 are depicted as being substantially equal in length, one arm 78 or 80 is shorter than the other in another embodiment.

Each arm 78 and 80 includes an end 86 and 88, respectively, that is configured to be inserted into corresponding ones of top openings 48 and 50 of vertical supports 36 and 38. In an embodiment, a lateral cross-sectional area of each arm 78 and 80 is substantially consistent along the length of each arm 78 and 80 and is substantially shaped identically to, but is smaller than, the lateral cross-sectional areas of corresponding top openings 48 and 50. In this manner, the entirety of the length of arms 78 and 80 can be disposed within vertical supports 36 and 38, if desired. Arms 78 and 80 include lower portions 81 and 83. Lower portions 81 and 83 respectively include ends 86 and 88 and are configured differently from upper portions 85 and 87 of arms 78 and 80. In an embodiment, lower portions 81 and 83 have H-shaped lateral cross sections, while upper portions 85 and 87 have rectangular or square shaped lateral cross sections. Alternatively, lower and upper portions 81, 83, 85, and 87 have substantially similar cross sections.

To allow vertical extender 14 to be adjustable vertically relative to frame 18, staggered openings 84, four of which are shown on each arm 78 and 80, are included along interior-facing surfaces 86 and 88 of arms 78 and 80, respectively. More or fewer openings 84 are included in other embodiments. Openings 84 are configured to correspond to and align with apertures 70 on vertical supports 36 and 38 to allow positioning of vertical extender 14 to be adjustable as desired. In one embodiment, top ends 90 and 92 of arms 78 and 80, respectively, define curved corners with middle bar 82 so that no visible seams appear when viewing vertical extender 14 to provide an aesthetically pleasing look.

Middle bar 70 includes two entirely separate rails 94 and 95 each having a top surface 96 that is even with the topmost edges of top ends 90 and 92. Middle bar 70 also has exterior-facing surfaces 98 and 99 that are substantially even with forward and rear surfaces 100 and 101 of arm 78 and forward and rear surfaces 102 and 103 of arm 80. Rails 94 and 95 are entirely spaced from each other and extend unsupported from each other and any other supports between top ends 90 and 92. Middle bar 70 defines an open channel or elongated slot 104 between rails 94 and 95. Open channel 104 provides space for the accommodating portions of clips or other coupling mechanisms for attaching signs to vertical extender 14. Open channel 104 initiates and terminates just inside of top ends 90 and 92. To provide a uniform look, middle bar 70 is configured to substantially match a cross-sectional shape and size of horizontal supports 40 and 42. For example, each rail 94 and 95 of middle bar 70 has a rectangular-shaped lateral cross section having a cross-sectional area that is substantially equal or similar to the lateral cross section of rails 74.

Vertical extender 14 is formed from a single material, such as a metal, plastic, or another structurally robust material. In an example, vertical extender 14 is molded as a single, unitary component. In another embodiment, arms 78 and 80 are formed separately, and rails 94 and 95 of middle bar 70 are welded or otherwise permanently coupled to arms 78 and 80. FIG. 8 illustrates a close-up view of a portion of vertical extender 14 shown in FIG. 7, which according to another example, includes a cap 108 formed from plastic or another smooth material applied over curved corners of top ends 90 and 92 of arms 78 and 80, respectively, to prevent customer injury if the customer contacts vertical extender 14.

As previously noted, vertical extender 14 increases display area and is configured to support signs. For example, as illustrated in FIGS. 9-13, one or more clips 110 (two are generally shown in the figures) attach signs 112 to rails 94 and 95. Clips 110 may be any suitable one of a variety of clips configured to hang from or extend upwardly from one of rails 94 and 95. In one example, each of clips 110 is configured to wrap around at least three sides of one of rails 94 and 95 to couple each clip 110 to the one of rails 94 and 95. In one embodiment, clips 110 are knuckle clips, and each includes a palm member 114 aligned with and disposed over a portion of a top surface of one of rails 94 and 95. Clip 110 includes two pairs of fingers 113 extending from opposite edges of palm member 114 such that rail 94 or 95 is friction fit between pairs of fingers 113.

In one example, each clip 110 includes an elongated channel member 118 attached to and extending substantially horizontal to a top surface of palm member 114. Elongated member 118 is configured to extend over a portion of corresponding rail 94 or 95 and, in one embodiment, has parallel flanges 120 facing each other and dimensioned to retain edge portions of corresponding panels 122 of signs 112. As a result, panels 122 stand substantially vertically upright relative to channel member 118. In one embodiment, flanges 120 are angled and/or biased toward each other such that panels 122 are angled and/or biased toward each other. As a result, sign 112 is retained between panels 122. Panels 122 are substantially transparent and clear or colored to allow indicia on sign 112 to be viewed. In an embodiment, sign 112 includes indicia printed on one side, and hence, by including two different rails 94 and 95 onto which clips 110 can attach, two separate signs 112 can be simultaneously used for front and/or rear display of the indicia. It will be appreciated that although both clips 110 are illustrated as knuckle clips, one or both, alternatively are different types of clips. Additionally, although each pair of panels 122 and corresponding signs 112 are configured to extend along only a portion of corresponding rails 94 and 95, panels 122 and signs 112 are longer or shorter in other embodiments.

Figure 14:
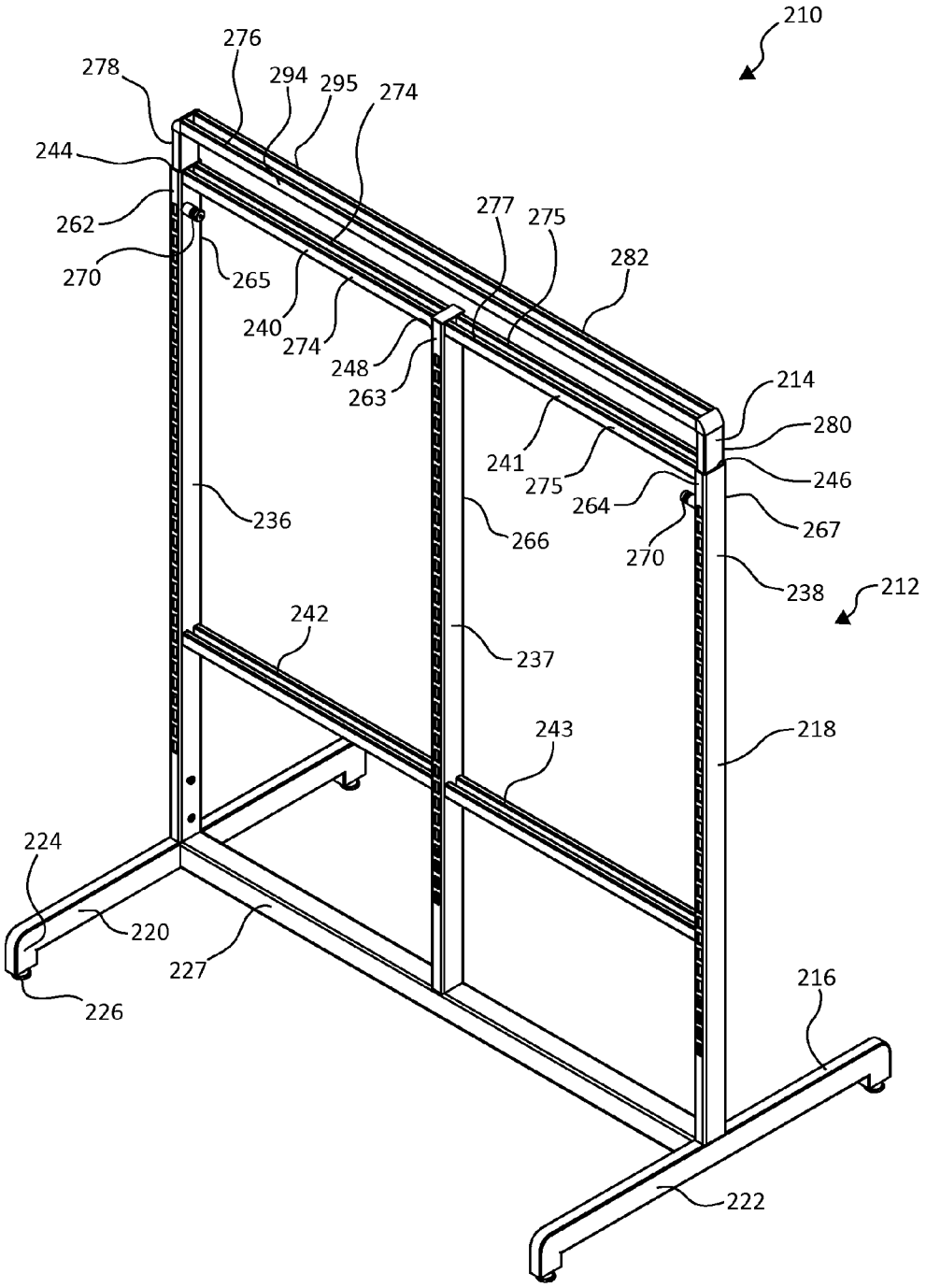
FIG. 14 is a front, perspective view illustration of a display structure, according to one embodiment of the present invention.
Figure 15:
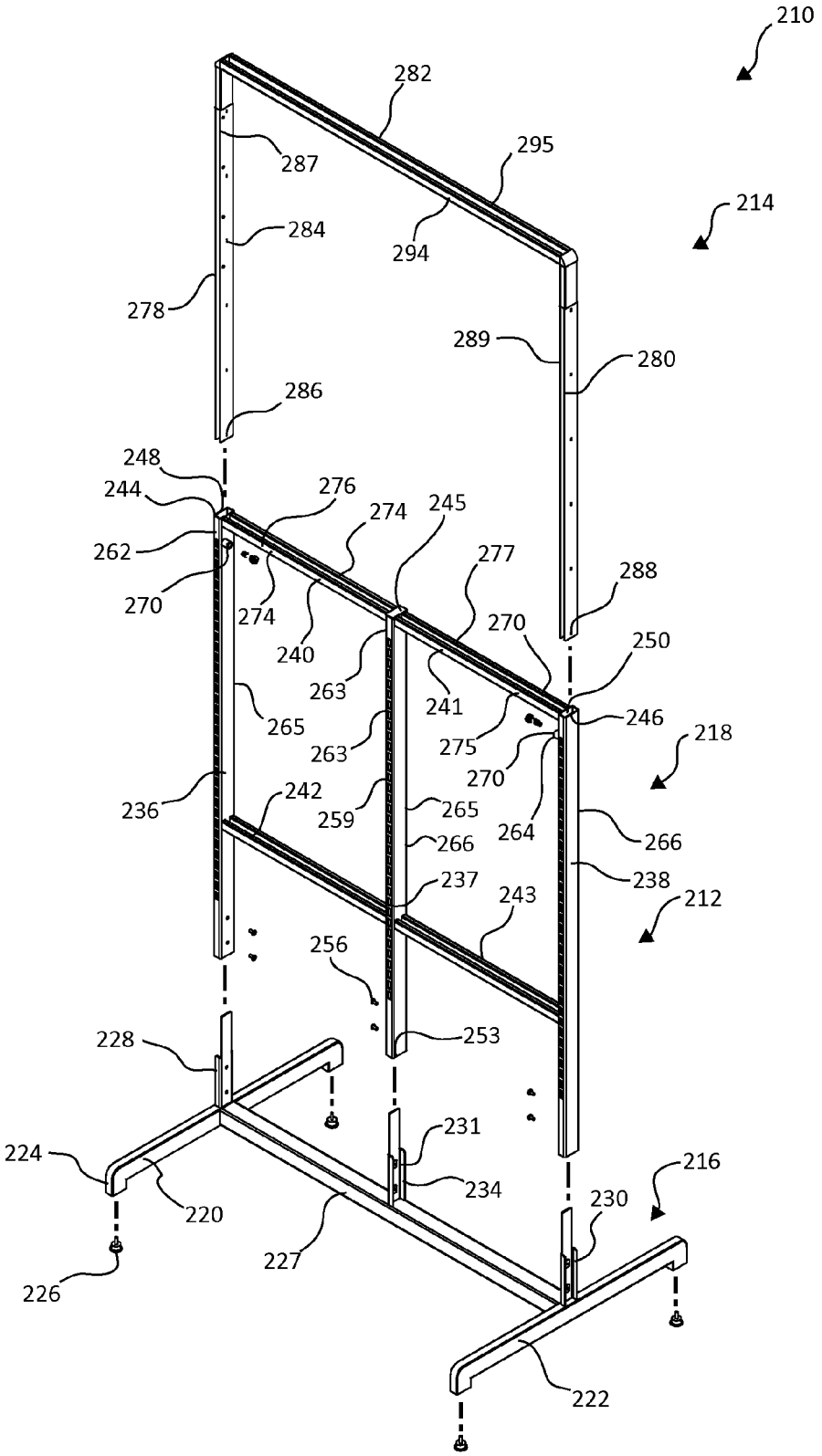
FIG. 15 is an exploded, perspective view of the display structure of FIG. 14, according to one embodiment of the present invention.

In other embodiments, vertical extender 14 can be used in conjunction with support structures that are wider than support structure 12. For example, with reference to FIGS. 14 and 15, a vertical extender 214, formed substantially similarly to extender 14, couples to a support structure 212 including a base 216 and a frame 218. Base 216 includes two horizontally-extending legs 220 and 222, feet 224, ball casters or pins 226, connector leg 227, and connector posts 228 and 230, that are configured substantially similarly to legs 20 and 22, feet 24, ball casters or pins 26, connector leg 27, and connector posts 30 and 32 except that connector leg 227 includes a connector post 231 extending from a middle portion thereof and substantially perpendicular thereto. Connector post 231 is configured to couple base 216 to frame 218 and includes fastener openings 234 for receiving corresponding portions of frame 218. Connector post 231 is configured substantially similarly to connector posts 228 and 230.

Frame 218 includes vertical supports 236 and 238 configured substantially similarly to supports 36 and 38 and also includes vertical support 237 located between vertical supports 236 and 238 to correspond to connector post 231. Vertical support 237 includes a bottom end 253 having an opening (not shown) to receive connector post 231. To secure vertical support 237 to connector post 231, fasteners 256 are inserted into openings (not shown) formed on vertical support 231 that correspond with fastener openings 234 of connector post 231. An array of slots 259 is formed on each of forward and rear surfaces 263 and 265 of vertical support 237 to receive hooks or other coupling mechanisms for hanging shelving or other display areas on either side of support structure 212. Top ends 244 and 246 of vertical supports 236 and 238 include top openings 248 and 250 configured substantially similarly to top openings 48 and 50.

Horizontal supports 240 and 241 form a top portion of frame 218. Horizontal support 240 extends between top ends 244 and 245 of vertical supports 236 and 237, respectively, and horizontal support 241 extends between top ends 245 and 246 of vertical supports 237 and 238, respectively. In one embodiment, each of horizontal supports 240 and 241 has a double rail configuration, and each rail 274 and 275 is configured substantially similarly to rail 74 described above. In an example, top surfaces 276 and 277 of each rail 274 and 275 extend in the same plane as a topmost edge of top ends 244, 245, and 246, and side surfaces of each rail 274 and 275 are located just inside of forward surfaces 262, 263, and 264 and rear surfaces 265, 266, and 267 of vertical supports 236, 237, and 238. In another embodiment, top surfaces 276 and 277 of each rail 274 and 275 are located just below the topmost edge of top ends 244, 245, and 246. Accordingly, in one example, rails 274 and 275 extend substantially parallel to each other and are entirely spaced from one another a distance to allow coupling mechanisms to fit therebetween.

Horizontal supports 242 and 243 are configured substantially similarly to horizontal supports 240 and 241. Horizontal support 242 extends between vertical supports 236 and 237, and horizontal support 243 extends between vertical supports 237 and 238 at locations below those of horizontal supports 240 and 241. For example, horizontal supports 242 and 243 are located at a position about two-thirds of the length of vertical supports 236 and 238 below horizontal supports 240 and 241. Although shown as being arranged linearly, alternatively horizontal supports 242 and 243 are arranged in a non-linear configuration.

Vertical extender 214 has two arms 278 and 280 positioned opposite one another and a middle bar 282 extending between arms 278 and 280. Similar to arms 78 and 80, arms 278 and 280 are substantially parallel to each other and disposed a distance apart that corresponds to the distance between vertical supports 236 and 238. Each arm 278 and 280 includes ends 286 and 288, respectively, that are inserted into corresponding ones of top openings 248 and 250 of vertical supports 236 and 238. A height of vertical extender 214 is adjustable vertically relative to frame 218 via staggered openings 284, three of which are shown on each arm 278 and 280, along interior-facing surfaces 287 and 289 of arms 278 and 280, respectively. More or fewer openings 284 are included in other embodiments. Openings 284 correspond to and align with apertures 270 on vertical supports 236 and 238 to allow positioning of vertical extender 214 to be adjusted as desired. Middle bar 282 has rails 294 and 295 that are substantially similar to rails 94 and 95 of middle bar 82, except that rails 294 and 295 are longer than rails 94 and 95.

Figure 16:
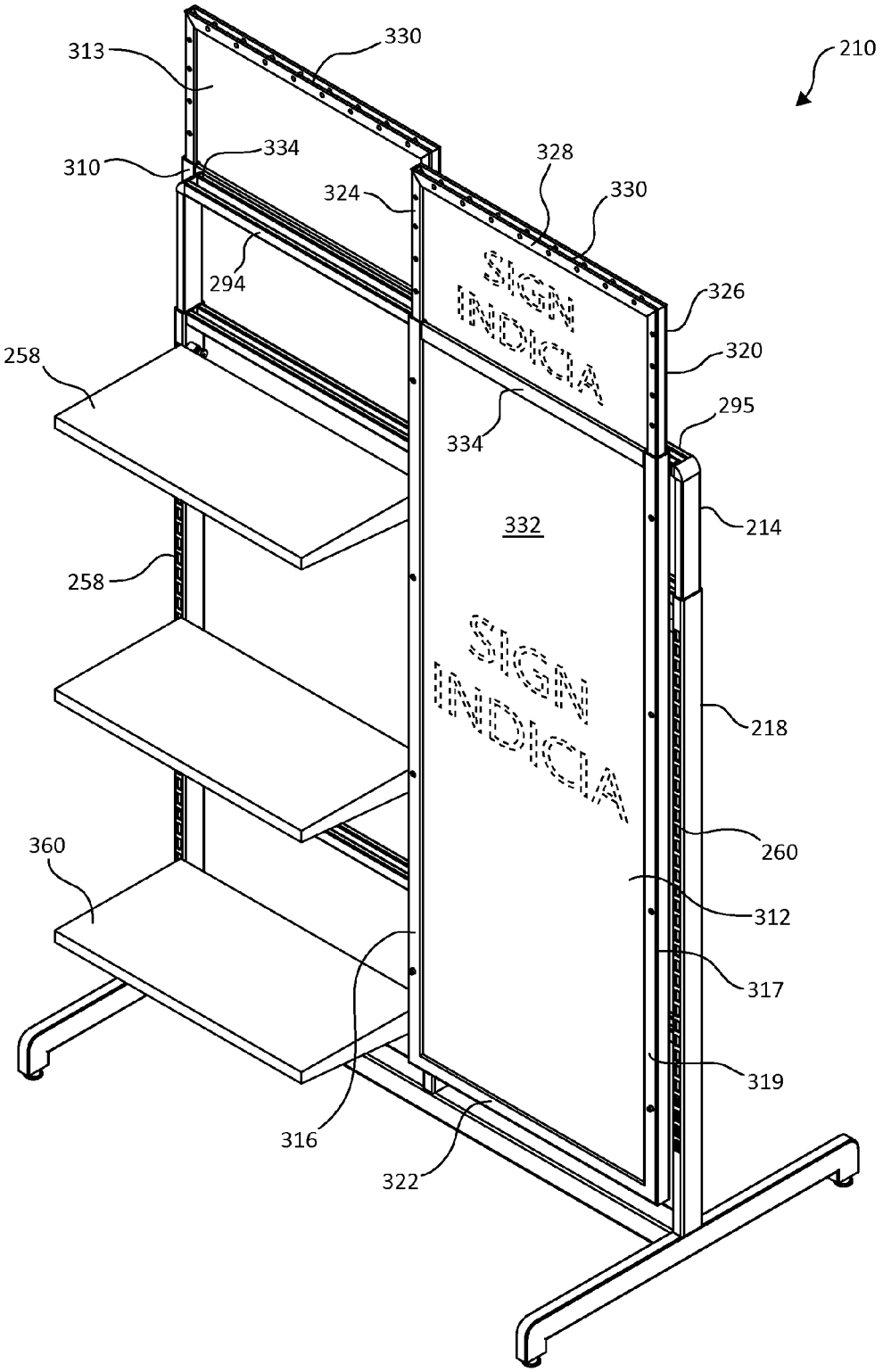
FIG. 16 is a front, perspective view illustration of a display structure including signage and shelving, according to one embodiment of the present invention.

By including a lengthened middle bar 282 and wider frame 218, additional display areas are available for use. For example, as illustrated in FIG. 16, elongated vertical signs 312 and 313 are attached to rails 294 and 295. Signs 312 and 313 face opposite directions and are simultaneously attached to front and rear rails 294 and 295 via clips 310. In one embodiment, each sign 312 and 313 covers about half of a vertical display area of frame 218 and extends vertically beyond rails 294 and 295. Those of skill in the art will appreciate that other signs with wrap around sign holders configured to receive one or front and rear rails 294 and 295 are also contemplated.

In one example, signs 312 and 313 each have a lower retention section 319 made up of two side segments 316 and 317 and a bottom segment 322 and an upper retention section 320 including two side portions 324 and 326 and a top portion 328. Side segments 316 and 317 of lower retention section 319 have top openings (not shown) that receive corresponding side portions 324 and 326, and top portion 328 includes a slot 330 through which an elongated panel 332 including indicia and the like is inserted. To retain panel 332, one or more of interior-facing surfaces of side segments 316 and 317, bottom segment 322 and side portions 324 and 326 includes grooves or other retention features (not shown) that maintain elongated panel 332 in position. In an embodiment, middle segment 334 extends between top ends of side segments 316 and 317 and includes a slot (not shown) to help retain panel 332 within retention sections 319 and 320.

Clip 310 is attached to or is formed as part of middle segment 334 and has a length that is substantially equal to or slightly less than a width of sign 312. Clip 310 is configured to hook over corresponding rail 294 or 295 and includes a horizontal strip protruding from middle segment 334 and a vertically-oriented strip extending from the edge of horizontal strip. As an alternative to employing clips 310, each sign 312 and/or 313 includes hooks (not shown) that can be aligned and engaged with slots 258 or 260 on vertical supports 236, 237, and 238 (slots for support 237 not shown).

In one example, shelving 360 is attached to vertical supports 236, 237, or 238 on a side opposite sign 312 or horizontally offset from sign to provide additional merchandise display space. In this regard, shelving 360 includes pegs or hooks (not shown) that engage with slots 258 or 260 on vertical supports 236, 237, or 238 (slots for support 237 not shown), respectively, depending on the side of display structure 218 to which shelving is attached. Other merchandise supports such as shelves, clothing rods, and other support structures may additionally be coupled with vertical supports 236, 237, and 238, e.g., via slots 258 and 260 in combination with any signs 312 and 313. Similar supports are also contemplated for use with convertible fixture 10.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A convertible fixture comprising:

a support structure including a pair of vertical supports, each vertical support of the pair of vertical supports being substantially hollow and defining an open top end; and a vertical extender adjustably coupled with the support structure, the vertical extender including:

a pair of side arms extending substantially parallel to each other and each defining a top end, wherein each side arm of the pair of side arms is formed with a closed shape cross section, and each side arm of the pair of side arms is slidably received within a different vertical support of the pair of vertical supports through a corresponding open top end of the different vertical support, and a middle bar extending between the top ends of the pair of side arms, the middle bar including two substantially parallel rails defining an elongated slot between the two substantially parallel rails and extending along a majority of a length of the middle bar;

wherein:

the pair of side arms and the middle bar are formed as a single, unitary component, each vertical support of the pair of vertical supports defines an interior facing surface, the interior facing surface of each vertical support of the pair of vertical supports defines an aperture, and each side arm of the pair of side arms includes an array of opening each configured to selectively align with the aperture of a corresponding one of the interior facing surfaces and to receive a pin therethrough to maintain the vertical extender at a desired height selected from a plurality of available heights for the vertical extender.

2. The convertible fixture of claim 1, wherein each of the two substantially parallel rails is substantially unsupported between the pair of side arms.

3. The convertible fixture of claim 1, wherein the two substantially parallel rails are spaced from each other along an entirety of their length between the pair of side arms.

4. The convertible fixture of claim 1, wherein an overall thickness of the middle bar is substantially identical to an overall thickness of each side arm of the pair of side arms.

5. The convertible fixture of claim 1, wherein the pair of vertical supports extends substantially continuously across a thickness of each vertical support of the pair of vertical supports.

6. The convertible fixture of claim 1, wherein each side arm of the pair of side arms includes an upper portion and a lower portion, the upper portion having the closed shape cross section, and the lower portion having a different shape cross section than the closed shape cross section.

7. The convertible fixture of claim 6, wherein the different shape cross section is a substantially H-shaped cross section.

8. The convertible fixture of claim 1, in combination with:

a first clip coupled to and extending around at least three sides of a first rail of the two substantially parallel rails of the middle bar; and a first sign attached to the first clip.

9. The combination of claim 8, further comprising:

a second clip coupled to and extending around at least three sides of a second rail of the two substantially parallel rails of the middle bar, and a second sign attached to the second clip.

10. The combination of claim 8, further comprising two panels, wherein:

the first clip has an elongated member attached to a top surface thereof including two or more longitudinal flanges receiving edge portions of each panel of the two panels between the two or more longitudinal flanges, and the first sign is retained between the two panels.

11. The combination of claim 8, wherein:

the pair of vertical supports each defines a plurality of slots, the convertible fixture further comprises a merchandise support member extending between the pair of vertical supports offset from the first sign, and the merchandise support member is coupled to each vertical support of the pair of vertical supports via the plurality of slots.

12. A convertible fixture combination comprising:

a convertible fixture including:

a support structure including a pair of vertical supports, each vertical support of the pair of vertical supports being substantially hollow and defining an open top end; and a vertical extender adjustably coupled with the support structure, the vertical extender including:

a pair of side arms extending substantially parallel to each other and each defining a top end, wherein each side arm of the pair of side arms is formed with a closed shape cross section, and each side arm of the pair of side arms is slidably received within a different vertical support of the pair of vertical supports through a corresponding open top end of the different vertical support, and a middle bar extending between the top ends of the pair of side arms, the middle bar including two substantially parallel rails defining an elongated slot between the two substantially parallel rails and extending along a majority of a length of the middle bar, wherein the pair of side arms and the middle bar are formed as a single, unitary component;

a first clip coupled to and extending around at least three sides of a first rail of the two substantially parallel rails of the middle bar;

a first sign attached to the first clip; and a channel coupled to the first clip and upwardly open to receive the first sign therein.

13. A convertible fixture combination comprising:

a convertible fixture including:

a support structure including a pair of vertical supports, each vertical support of the pair of vertical supports being substantially hollow and defining an open top end; and a vertical extender adjustably coupled with the support structure, the vertical extender including:

a pair of side arms extending substantially parallel to each other and each defining a top end, wherein each side arm of the pair of side arms is formed with a closed shape cross section, and each side arm of the pair of side arms is slidably received within a different vertical support of the pair of vertical supports through a corresponding open top end of the different vertical support, and a middle bar extending between the top ends of the pair of side arms, the middle bar including two substantially parallel rails defining an elongated slot between the two substantially parallel rails and extending along a majority of a length of the middle bar, wherein the pair of side arms and the middle bar are formed as a single, unitary component;

a first clip coupled to and extending around at least three sides of a first rail of the two substantially parallel rails of the middle bar; and a first sign attached to the first clip;

wherein the first sign extends substantially vertically to obscure a portion of the first rail of the two substantially parallel rails from view.

14. A convertible fixture combination comprising:

a convertible fixture including:

a support structure including a pair of vertical supports, each vertical support of the pair of vertical supports being substantially hollow and defining an open top end; and a vertical extender adjustably coupled with the support structure, the vertical extender including:

a pair of side arms extending substantially parallel to each other and each defining a top end, wherein each side arm of the pair of side arms is formed with a closed shape cross section, and each side arm of the pair of side arms is slidably received within a different vertical support of the pair of vertical supports through a corresponding open top end of the different vertical support, and a middle bar extending between the top ends of the pair of side arms, the middle bar including two substantially parallel rails defining an elongated slot between the two substantially parallel rails and extending along a majority of a length of the middle bar wherein the pair of side arms and the middle bar are formed as a single, unitary component;

a first clip coupled to and extending around at least three sides of a first rail of the two substantially parallel rails of the middle bar;

a first sign attached to the first clip;

a second clip coupled to and extending around at least three sides of a second rail of the two substantially parallel rails of the middle bar, and a second sign attached to the second clip;

wherein the first sign and the second sign laterally overlap one another while being substantially entirely spaced apart from one another.

15. A convertible fixture combination comprising:

a convertible fixture including:

a support structure including a pair of vertical supports, each vertical support of the pair of vertical supports being substantially hollow and defining an open top end; and a vertical extender adjustably coupled with the support structure, the vertical extender including:

a pair of side arms extending substantially parallel to each other and each defining a top end, wherein each side arm of the pair of side arms is formed with a closed shape cross section, and each side arm of the pair of side arms is slidably received within a different vertical support of the pair of vertical supports through a corresponding open top end of the different vertical support, and a middle bar extending between the top ends of the pair of side arms, the middle bar including two substantially parallel rails defining an elongated slot between the two substantially parallel rails and extending along a majority of a length of the middle bar wherein the pair of side arms and the middle bar are formed as a single, unitary component;

a first clip coupled to and extending around at least three sides of a first rail of the two substantially parallel rails of the middle bar;

a first sign attached to the first clip;

a second clip coupled to and extending around at least three sides of a second rail of the two substantially parallel rails of the middle bar, and a second sign attached to the second clip;

wherein the second sign extends substantially vertically to obscure a portion of the second rail of the two substantially parallel rails from view.

16. A display system for use in a retail setting comprising:

a base;

a frame including two upright supports extending from the base, each of the two upright supports having a top opening; and a unitary U-shaped member including:

a first arm having a first end inserted into the top opening of a first upright support of the two upright supports;

a second arm having a first end inserted into the top opening of a second upright support of the two upright supports; and a double rail member extending from a second end of the first arm opposite the first end of the first arm to a second end of the second arm opposite the first end of the second arm, the double rail member defining a substantially rectangular channel extending between the first arm and the second arm;

wherein:

each of the two upright supports includes an interior-facing aperture;

the first arm and the second arm each include an interior-facing opening aligned with the interior-facing aperture of a corresponding one of the two upright supports; and two pins each inserted through a corresponding interior-facing aperture and a corresponding interior-facing opening to couple the U-shaped member to the frame.

17. The display system of claim 16, wherein each of the two upright supports is formed with a single continuous closed shape support cross section, and at least a top portion of each of the first arm and the second arm is formed with a single continuous closed shape arm cross section.

18. The display system of claim 16, further comprising:

a first sign assembly coupled to a first rail of the double rail member, the first sign assembly including a first clip attached to and wrapping around the first rail and a first sign extending from the first clip.

19. The display system of claim 18, wherein the first sign includes a lower section configured to be disposed between the two upright supports and an upper section extending vertically from the lower section above the double rail member.

20. The display system of claim 18, wherein the frame includes an additional upright support disposed between and extending substantially parallel to and in substantially the same plane as the two upright supports, the additional upright support dividing the frame into two display sections.

21. The display system of claim 18, further comprising shelving attached to the frame on a side opposite the first sign assembly.

* * * * *